US008925140B1

(12) United States Patent
Troiani

(10) Patent No.: US 8,925,140 B1
(45) Date of Patent: Jan. 6, 2015

(54) INTERCHANGEABLE EXPRESSIONS BATH SPONGE

(71) Applicant: Pamela Marie Troiani, Derry, NH (US)

(72) Inventor: Pamela Marie Troiani, Derry, NH (US)

( * ) Notice: Subject to any disclaimer, the term of this patent is extended or adjusted under 35 U.S.C. 154(b) by 0 days.

(21) Appl. No.: 14/481,242

(22) Filed: Sep. 9, 2014

Related U.S. Application Data

(60) Provisional application No. 61/884,402, filed on Sep. 30, 2013.

(51) Int. Cl.
*A47K 7/02* (2006.01)

(52) U.S. Cl.
CPC ..... *A47K 7/028* (2013.01)
USPC ..... 15/244.1; 15/210.1

(58) Field of Classification Search
USPC ..... 15/210.1, 229.13, 244.1, 244.2; D32/43
See application file for complete search history.

(56) References Cited

U.S. PATENT DOCUMENTS

| | | | | | |
|---|---|---|---|---|---|
| D100,569 | S | * | 7/1936 | Lewis | D32/43 |
| D274,378 | S | * | 6/1984 | DeBrouse | D30/158 |
| 5,548,862 | A | * | 8/1996 | Curtis | 15/118 |
| 5,598,596 | A | * | 2/1997 | Jones et al. | 15/1.52 |
| 5,983,435 | A | * | 11/1999 | Osborne | 15/209.1 |
| 6,105,196 | A | * | 8/2000 | Chang | 15/209.1 |
| 6,685,376 | B2 | * | 2/2004 | Weihrauch | 401/196 |
| 2004/0177863 | A1 | * | 9/2004 | McKay | 134/6 |

* cited by examiner

*Primary Examiner* — Randall Chin
(74) *Attorney, Agent, or Firm* — Ben Williams

(57) ABSTRACT

An interchangeable expressions bath sponge having a plurality of interchangeable sponge heads attachable endwise to a water resistant handle, each of said plurality of interchangeable sponge heads including a durably printed caricature or image inferential and communicative of a particular mood to a user, wherein a range of moods is displayable by the plurality of interchangeable sponge heads and a user is enabled selection of a desired sponge head indicative to showcase a particular mood when showering or bathing, as desired.

3 Claims, 3 Drawing Sheets

INTERCHANGEABLE EXPRESSIONS BATH SPONGE

BACKGROUND OF THE INVENTION

Various types of bath sponge are known in the prior art. However, what is needed is an interchangeable expressions bath sponge that includes a sponge head which is both replaceable and interchangeable, each sponge head featuring a different caricature facial expression or other image, so that the user may have a variety of images from which to choose and which may be employed to either reflect or change the current mood or frame of mind of said user.

While serving the practical purpose of providing a means to clean and exfoliate areas which are either difficult or impossible to reach during bath or shower, the interchangeable expressions bath sponge features a plurality of durably imprinted images on different colored sponges that make it not only functional as a bath sponge, but attractive as an ornament and useful as a whimsical and pleasant alternative to the ordinary variety of bath sponges.

The interchangeable expressions bath sponge is contemplated to introduce some fun and novelty into the mundane every-day act of bathing, and is anticipated to make bath time a more palatable activity for children. Adults are anticipated to enjoy the choice of different expressions and icons as a preferable alternative to ordinary, utilitarian bath sponges.

New and different durably imprinted caricatures depicting various emotional expressions, and other images will be available on replacement sponge heads, in a variety of colors, and each sponge head may be used attached to or independent of the water resistant handle.

Each interchangeable sponge head features a hanging cord by which the interchangeable expressions bath sponge may be hung for drying and convenient accessability from shower or bath, or hung without the handle as ornament or to display the choices of sponge heads available.

FIELD OF THE INVENTION

The present invention relates to an interchangeable expressions bath sponge, and more particularly, to an interchangeable expressions bath sponge which offers a broad variety of choices of different images displayed on the user's choice of sponge head.

Each image imprinted upon each of a plurality of interchangeable sponge heads is anticipated to vary broadly, offering the user an individualized choice that may reflect a mood, positively alter said mood, or signal said mood to others.

Each of the plurality of interchangeable sponge heads, which may be used to effect cleaning and exfoliation during a shower or bath, either with or without the water resistant handle, features a different, durably imprinted image on a soft bath sponge in a variety of colors, and is intended to be an attractive bath time novelty for children.

While each interchangeable sponge head may be used independently of the associated water resistant handle, when attached to the water resistant handle they allow the user to bathe and exfoliate areas that might otherwise be difficult or impossible to reach. Said handle features a non-slip grip which allows good purchase even when wet.

A hanging cord is attached at the top of each interchangeable sponge head, by means of which the interchangeable expressions bath sponge may be hung to dry, and remain conveniently available within reach of the bath or shower. This hanging cord also allows the range of alternate choices of interchangeable sponge heads to be displayed, or for the interchangeable sponge heads to be hung as an ornament.

SUMMARY OF THE INVENTION

The general purpose of the interchangeable expressions bath sponge, described subsequently in greater detail, is to provide an interchangeable expressions bath sponge which has many novel features that result in an interchangeable expressions bath sponge which is not anticipated, rendered obvious, suggested, or even implied by prior art, either alone or in combination thereof.

The interchangeable expressions bath sponge offers an attractive and amusing alternative to ordinary, utilitarian bath sponges. A user may choose between a plurality of interchangeable sponge heads of a variety of colors, each featuring a different caricature or image expressive of a range of different moods or emotions. These images are anticipated to reflect the user's current mood, improve said user's current mood, or signal said user's current mood to others.

These interchangeable sponge heads are also anticipated to be attractive to children and a useful enticement to said children to enjoy bathing, which many children may otherwise dislike.

While the interchangeable sponge heads may be used independently from the water resistant handle, attachment to the water resistant handle allows the user to bathe and exfoliate areas that might otherwise be difficult or impossible to reach. Said handle features a tactile and conformable non-slip grip which allows good purchase even when wet.

A hanging cord is attached to the top of each interchangeable sponge head by means of which the interchangeable expressions bath sponge may be hung to dry and to provide convenient accessibility within reach of the bath or shower. This hanging cord also allows alternate choices of interchangeable sponge heads to be displayed, or hung as an ornament.

Thus has been broadly outlined the more important features of the present interchangeable expressions bath sponge so that the detailed description thereof that follows may be better understood and in order that the present contribution to the art may be better appreciated.

Objects of the present interchangeable expressions bath sponge, along with various novel features that characterize the invention are particularly pointed out in the claims forming a part of this disclosure. For better understanding of the interchangeable expressions bath sponge, its operating advantages and specific objects attained by its uses, refer to the accompanying drawings and description.

BRIEF DESCRIPTION OF THE DRAWINGS

Figures

DETAILED DESCRIPTION OF THE DRAWINGS

Figure 1:
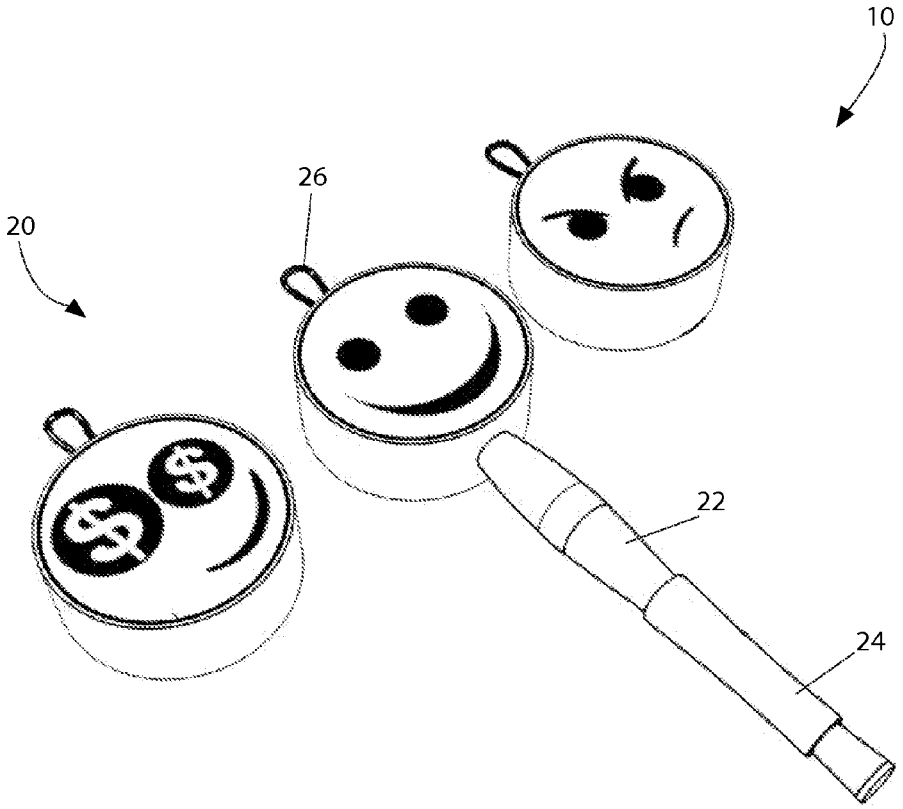
FIG. 1 is an isometric view of a plurality of interchangeable sponge heads depicting caricatures or emotive images inferential and communicative of a range of emotions, with one of said plurality of interchangeable sponge heads attached endwise to a water resistant handle.
Figure 2:
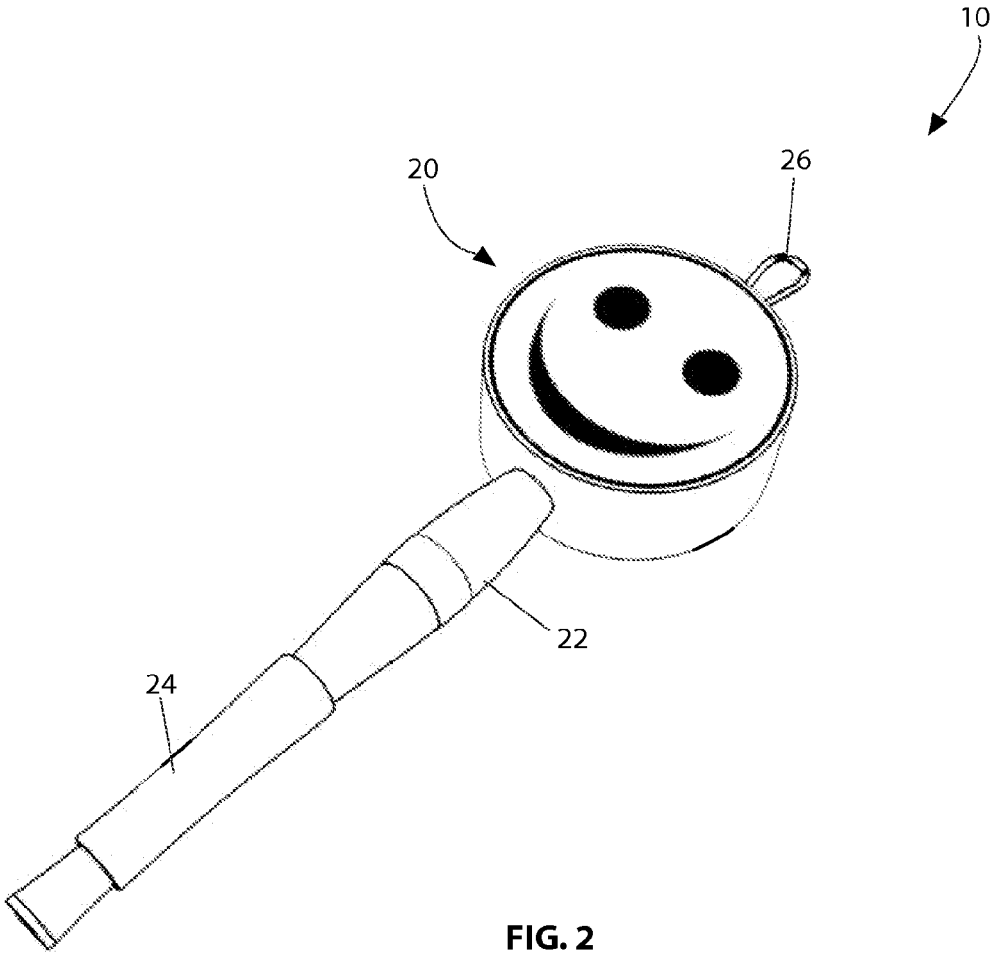
FIG. 2 is an isometric view of one of a plurality of interchangeable sponge heads attached to the water resistant handle, said one of a plurality of interchangeable sponge heads depicting happiness.
Figure 3:
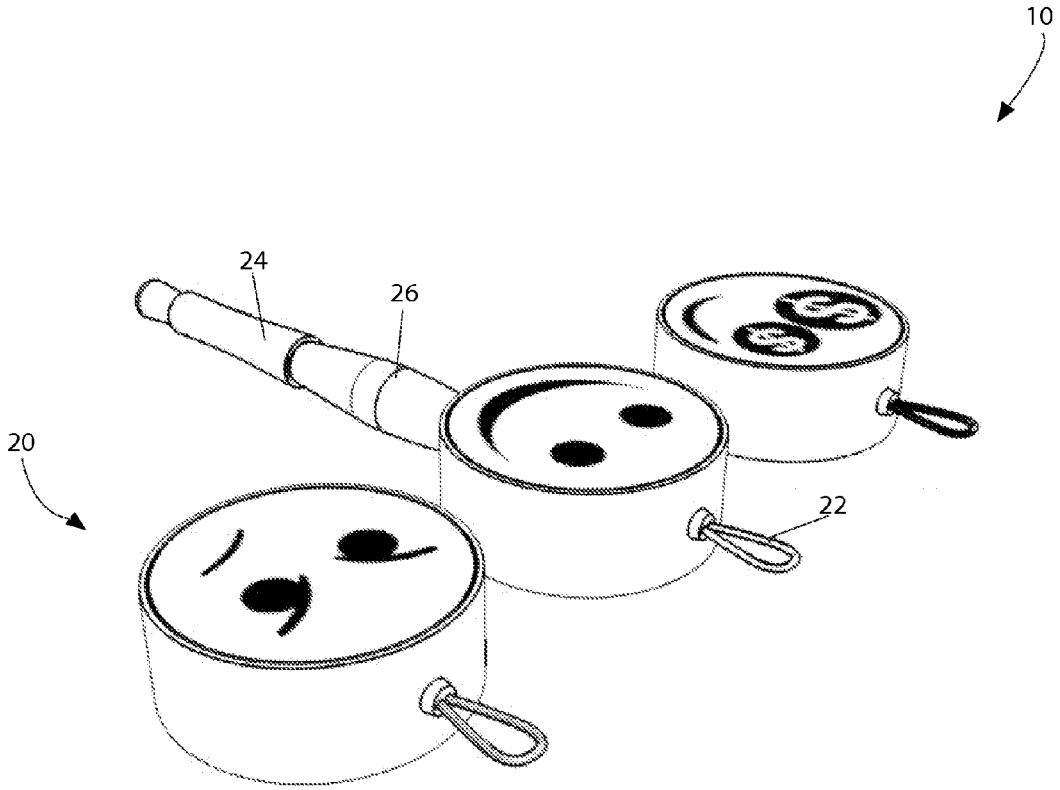
FIG. 3 is an elevated view of the plurality of interchangeable sponge heads attachable to the water resistant handle.

With reference now to the drawings, and in particular FIGS. 1 through 3 thereof, example of the instant interchangeable expressions bath sponge employing the principles and concepts of the present interchangeable expressions bath sponge and generally designated by the reference number 10 will be described.

Referring to FIGS. 1 through 3 a preferred embodiment of the present interchangeable expressions bath sponge 10 is illustrated.

The interchangeable expressions bath sponge 10 has been devised to enable it's user to choose between a plurality of interchangeable sponge heads 20, each of said plurality of interchangeable sponge heads releasably attachable to a water resistant handle 22. Any one of the plurality of interchangeable sponge heads 20 may be detached from the handle 22 and replaced with a different one of the plurality interchangeable sponge heads 20, as desired.

The water resistant handle 22 features a non-slip grip 24, which allows the user to ergonomically grasp the interchangeable expressions bath sponge 10 when in use, even when wet.

A hanging cord 26 is attached to the top of each interchangeable sponge head 20, by which the interchangeable expressions bath sponge 10 may be hung to dry, and positioned conveniently accessible proximal a bath or shower. Each of the plurality of interchangeable sponge heads 20 may be hung by each associated hanging cord 26, therefore, in order to display a range of choices to the user.

The practical function of the interchangeable expressions bath sponge 10 is to allow a user to clean and exfoliate areas, when bathing or showering, that are otherwise difficult or impossible to reach, but with the added dimension of providing a choice of iconic images that may elevate, alter, or improve said user's frame of mind, or signal said user's frame of mind to others.

It is further contemplated that the interchangeable expressions bath sponge 10 will be popular with children, and will help to incentivize them to bathing.

Each of the plurality of interchangeable sponge heads 20 is contemplated to feature a durably printed caricature or image on a variety of different colored sponges, depicting facial expressions in a wide variety of emotions, including, but not limited to: happiness, shyness, crankiness, coquettishness, sleepiness, among other moods or emotions, so that the user may choose from among a broad range of whimsical caricatures or icons a desired interchangeable sponge head 20. Each interchangeable sponge head 20 may also be used as a bath sponge without being attached to the water resistant handle 22.

The interchangeable sponge heads 20 are also contemplated to have ornamental value, and may be collected, hung as decoration separate from the water resistant handle 22, given as gifts, among other uses.

What is claimed is:

1. An interchangeable expressions bath sponge comprising:

at least one water resistant handle;

a non-slip grip disposed upon the at least one water resistant handle;

a plurality of interchangeable sponge heads, each of said plurality of interchangeable sponge heads releasably attachable endwise to the at least one water resistant handle; and a hanging cord disposed atop each of the plurality of interchangeable sponge heads;

wherein each of the plurality of interchangeable sponge heads includes a durably printed caricature or image on a surface thereof, each of said caricatures or images depicting an emotive facial expression inferential and communicative of a particular mood, whereby a range of moods is displayable across the plurality of interchangeable sponge heads and a particular mood is selectable for use when showering or bathing, as desired.

2. The interchangeable expressions bath sponge of claim 1 wherein the plurality of interchangeable sponge heads depict a range of moods including caricatures or images inferential and communicative of happiness, shyness, crankiness coquettishness, and sleepiness.

3. The interchangeable expressions bath sponge of claim 2 wherein each of the plurality of interchangeable sponge heads is a different color.

* * * * *